US005136343A

United States Patent [19]

Braswell

[11] Patent Number: 5,136,343

[45] Date of Patent: Aug. 4, 1992

[54] HIGH-VOLUME DUPLICATOR HAVING EFFICIENT OPERATION IN THE UNCOLLATED DUPLEX MODE

[75] Inventor: Charles D. Braswell, Henrietta, N.Y.

[73] Assignee: Xerox Corporation, Stamford, Conn.

[21] Appl. No.: 744,104

[22] Filed: Aug. 13, 1991

[51] Int. Cl.[5] ..... G03G 15/00

[52] U.S. Cl. ..... 355/319; 355/322; 271/287

[58] Field of Search ..... 355/368, 321, 322, 323, 355/319; 270/58; 271/287, 288, 298, 279

[56] References Cited

U.S. PATENT DOCUMENTS

| | | | |
|---|---|---|---|
| 3,395,913 | 8/1968 | Del Vecchio et al. . | |
| 3,709,480 | 1/1973 | Schulze et al. . | |
| 4,099,254 | 7/1978 | Andrews et al. . | |
| 4,405,225 | 9/1983 | Perrault . | |
| 4,530,593 | 7/1985 | Kasuya et al. | 355/323 |
| 4,698,772 | 10/1987 | Carter et al. . | |
| 4,934,681 | 6/1990 | Holmes et al. . | |
| 4,941,023 | 7/1990 | Holmes et al. . | |
| 4,974,034 | 11/1990 | Rabb et al. | 355/319 |

FOREIGN PATENT DOCUMENTS

| | | | |
|---|---|---|---|
| 2-43177 | 2/1990 | Japan | 271/287 |

*Primary Examiner*—Joan H. Pendegrass
*Attorney, Agent, or Firm*—Finnegan, Henderson, Farabow, Garrett & Dunner

[57] ABSTRACT

A copy system has a duplicator and a large capacity sorter. The duplicator has a limited capacity duplex tray that supports copy processing in the duplex mode. The sorter has up to 10 towers with 60 bins provided in each tower. The maximum bin capacity is 100 sheets, so that the system can handle up to 60,000 copies. Horizontal and vertical transports are provided for each tower and a bin deflector is provided for each bin. Each tower has a local control that is directed by a centralized sorter control. A duplicator control is provided for running the copy process in the duplicator and for directing the sorter control to achieve coordinated operation of the duplicator and sorter. In the uncollated, duplex mode, duplex copies are produced in segment sizes up to the duplex tray capacity limit. Copies of each original in successive copy segments are delivered to consecutive bins in a common bin area in a pair of the towers thereby forming a readily identified copy stack for that stack in the common bin area. Successive copy segments are delivered to consecutive common bin areas.

13 Claims, 16 Drawing Sheets

SORTED JOB-1000 COPIES OF EACH OF 8 ORIGINALS OR1-OR8-100 COPIES PER BIN

HIGH-VOLUME DUPLICATOR HAVING EFFICIENT OPERATION IN THE UNCOLLATED DUPLEX MODE

CROSS-REFERENCE TO RELATED APPLICATIONS

Reference is made to the following related patent applications filed concurrently herewith and assigned to the present assignee:

Ser. No. 07/744,162 (4629-033) entitled HIGH-VOLUME DUPLICATOR SYSTEM AND METHOD PROVIDING EFFICIENT TOWER AND DUPLICATOR OPERATION AND FACILITATED UNLOADING IN THE COLLATED DUPLEX MODE by Charles D. Braswell, Robert E. Carley and Riley L. Warddrip.

Ser. No. 07/744,131 (4629-034) entitled HIGH-VOLUME DUPLICATOR PROVIDING EFFECTIVE SEPARATION OF COPY STACKS by Charles D. Braswell.

Ser. No. 07/744,103 (4629-035) entitled HIGH-VOLUME DUPLICATOR SYSTEM AND METHOD PROVIDING EFFICIENT SYSTEM OPERATION IN THE COLLATED SIMPLEX LIMITLESS MODE, by Charles D. Braswell and Riley L. Warddrip.

Ser. No. 07/744,034, Xerox Docket D91257, UNLIMITED DOCUMENT FEEDER, by Charles D. Braswell.

BACKGROUND OF THE INVENTION

The present invention relates to a high-volume, post-collation copy engine or duplicator system in which system control is provided to coordinate and integrate duplicator and large capacity sorter operations for efficient, low cost and flexible operation of the reproduction process.

There are a variety of commercial applications of reproduction technology where a need exists to reproduce manuals or books, or sets thereof, containing up to thousands of pages that are suitably assembled such as in three-ring binders or in bound units. A large number of book copies may be required for distribution to users or customers. Applications like these are called high-volume applications.

In particular high-volume applications, the books may have to be revised or updated periodically, such as every three or six months. In the revision process, some but normally not all pages will be modified and some pages may be deleted or added. In many cases, trade practices or regulatory requirements may make it necessary to reproduce the entire revised book or set of books as opposed to reproducing insert pages for appropriate placement in the original book copies. In any case, the page insert approach is typically undesirable because it is labor intensive and because of the likelihood of assembly errors.

The original text, graphics, and photographs, that constitute the book content, may reside in multiple sources. For example, an original may reside on microfilm, in electronic storage, on standard 8½"×11" paper, or on "paste-ups". Originals from which reproductions are to be made are derived from the multiple storage sources and placed on one or more selected media.

A typical commercial application in which high-volume reproduction technology is needed is that in which a manufacturer makes and sells relatively complex products for which maintenance books must be issued and revised from time to time. The production of maintenance books for a product which may be supplied in a variety of forms or models typically is relatively complex because of book differences that are required for different models and/or customers.

Offset lithography is one process that has often been used for high-volume reproduction, but it is typically relatively expensive. In this process, extensive setup time is required for building each master original or revised original. Relatively high pressman labor operating costs are incurred, and up to 10% of the total copy output constitutes waste copies caused by process adjustment during job startup and shutdown. It is noteworthy, however, that offset lithography does in general provide high resolution production of photographic originals.

Large output sorters, having multiple towers containing up to 600 or more bins, have been employed in offset lithography to support post-collation book production for high-volume jobs. However, the operation of such sorters and the lithography production process as a whole has been relatively inflexible especially in terms of accommodating more complex jobs that involve varying production requirements within a particular job or from job to job. Such inflexibility stems from the very nature of the whole lithographic reproduction and sorting process along with an absence of process controls that, if implementable at all, could otherwise facilitate the creation of added process flexibility.

In high-volume jobs that require "limitless" sorting, that is, a number of copies greater than the machine reproduction capacity, typically the operator of the lithography process must determine the job breakup and run the job parts accordingly. Another example of relative inflexibility in the offset lithography process is that in which some book copies may require certain pages to be different from corresponding pages in other book copies. While the lithography process may be operated to permit collation of the proper page copies in the various book copies, such process operation is highly inefficient, costly and inconvenient.

An additional example of flexibility limits in the offset lithography process is that in which a capability is needed for job parking at the end of work shifts. A job is parked when work is left in sorter bins at the end of a shift and the job is picked up again on the next shift, often the next day. The lithography pressman has limited system hardware support in resuming the parked job and completing it.

Pre-collation copying with use of a duplicator is another process that has been used for reproducing multiple copies of original manuals or books. However, the machine capacity limits successive segment sizes which therefore must be "hand-married" or manually collated after production. Copy integrity is also a problem in the pre-collation reproduction process. Thus, an occasional skewing of an original document on the platen glass requires inspection of all output copies to uncover any skewed ones and thereby assure copy product quality. Such inspection is impractical for high-volume jobs.

Another process that lends itself to high-volume reproduction is a process in which post-collation copying is performed with use of a duplicator and a high capacity sorter. Generally, the availability of electronic control with a duplicator provides a basic capability for creating process flexibility in high-volume reproduction jobs.

As compared to a pre-collation duplicator process, a postcollation duplicator process facilitates the performance of highly complex jobs because the layout of collation bins allows for the tailoring of some book copies to meet the requirements of particular customers or particular product models. Moreover, possible future commercial use of a common electronic format for source originals could be efficiently implemented in high-volume reproduction jobs with the use of electronically controlled duplicators.

High-volume, post-collation duplicators have been generally unavailable commercially because of a lack of required technology development.

More specifically, in a conventional duplicator having a sorter, the requested quantity of copies of successive originals are normally distributed sequentially in the sorter bins. Sorter return to the starting bin occurs only after that bin has been emptied. In the uncollated duplex mode of a high-volume duplicator, this conventional procedure results in a copy output distribution that can be very confusing to the operator of the duplicator.

As an illustration, in a duplicator having a duplex tray with a 100 sheet capacity, the duplicator is limited to making 100 duplex copies of an original or original pair before moving to the next original or original pair. If the requested copy quantity is 1000, for example, 100 copies of original ½ would be sent to the first bin or set of bins (either of which corresponds to a logical bin), 100 copies of original ¾ would be sent to the next logical bin, and 100 copies of each successive original would be sent to successive logical bins in sequence until all of the originals have been processed.

Since 1000 copies are needed for each original, the originals are again copied to place 100 copies of each in succession in the next set of logical bins corresponding in number to the number N of originals. This process is repeated eight additional times to produce the requested copy quantity of 1000 for each original.

As a result, 100 copies of original ½ are located in the first logical bin, 100 copies of original ¾ are located in the second logical bin, etc. through the Nth logical bin where the 100 copies of the Nth copy are sent. The 1000 copy stack of each successive original is thus broken into ten 100 copy stacks which are separated by stacks of 100 copies of other originals. In high-volume copy work, such output delivery of copies would be confusing to the duplicator operator and therefore is undesirable from a product marketing standpoint.

SUMMARY OF THE INVENTION

The present invention has been made in view of the above circumstances and has as an object the provision of a high-volume copy engine or duplicator system in which output copy delivery is efficiently provided in the uncollated duplex mode without creating operator confusion.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims To achieve the objects and in accordance with the purpose of the invention, as embodied and broadly described herein, the copy system of this invention comprises means for duplicating successive original documents, the duplicating means having a limited capacity duplex tray for supporting copy processing in the duplex mode, means for sorting output copies delivered from the duplicating means, the sorting means including a plurality of towers each of which has a plurality of bins, means for transporting output copies to each of the towers, means for directing output copies in each tower to each bin therein, and means for controlling the duplicating means and the transporting and directing means for the towers and the bins in the uncollated duplex mode to produce duplex copies in segment sizes up to the duplex tray capacity limit and to deliver copies of each original in successive copy segments to successive bins in a common bin area in one or more of the towers so as to form a copy stack for that original in the common bin area.

BRIEF DESCRIPTION OF THE DRAWINGS

The accompanying drawings, which are incorporated in and constitute a part of this specification illustrate one embodiment of the invention and together with the description provide an explanation of the objects, advantages and principles of the invention. In the drawings:

FIG. 5A1 portrays a functional block diagram of a control system for the duplicator of FIG. 2;

FIG. 5A2 shows a diagram of a programmed functional sequence employed in the duplicator control to start and stop sorter operation;

DESCRIPTION OF THE PREFERRED EMBODIMENT

Figure 1:
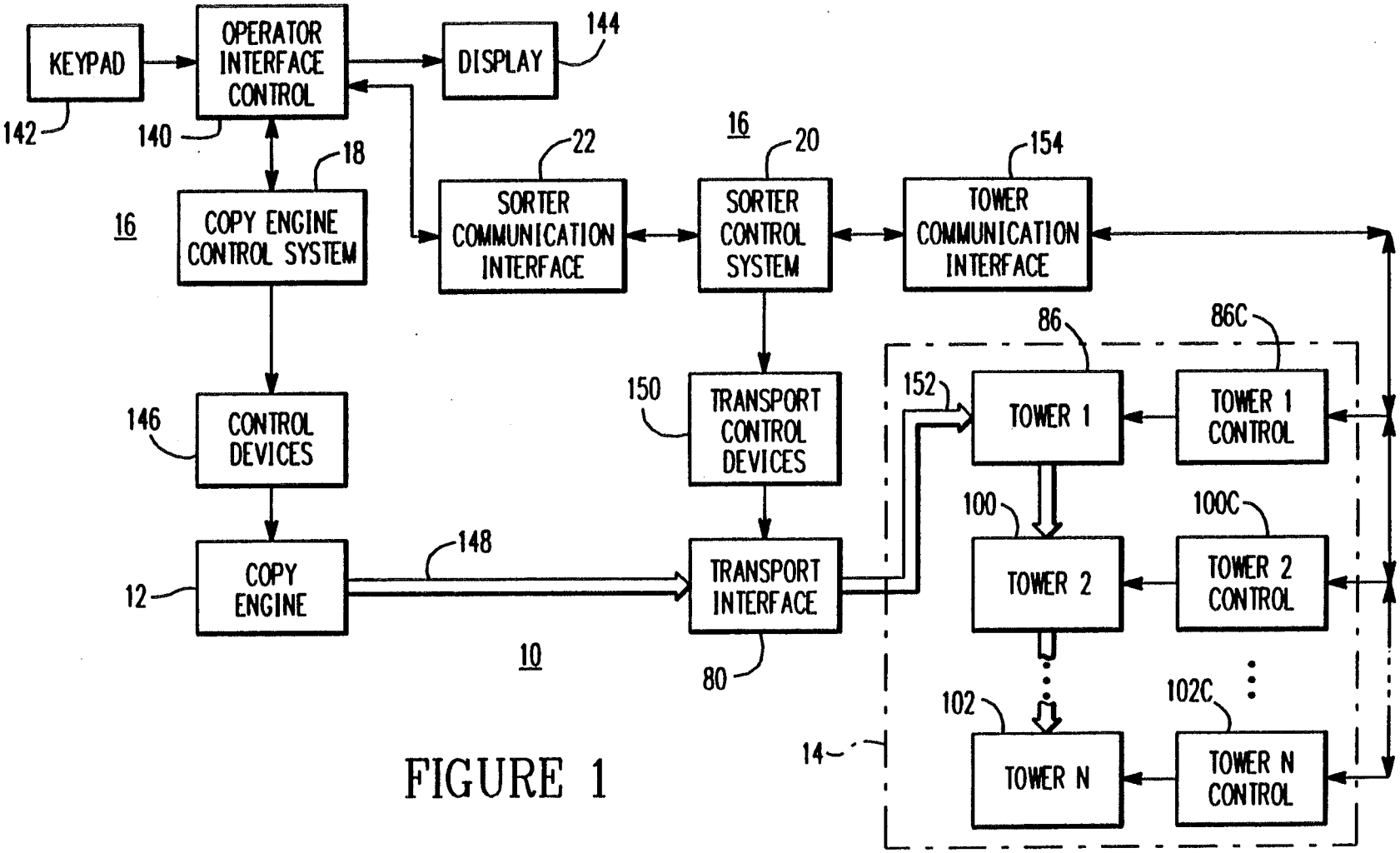
FIG. 1 is a block diagram of a copy system arranged in accordance with the principles of the present invention.

There is shown in FIG. 1 a copy system 10 having means for producing copies of original documents and means for sorting the copies for assembly into collated books or the like. The system 10 employs a copy engine 12 that in this preferred embodiment is in the form of a xerographic duplicator. Further, the system 10 employs a multi-tower sorter 14 that is coupled to the engine or duplicator 12 to receive copies as they are produced and direct them into tower bins as required for collated distribution assembly into books or manuals.

Generally, the copy system 10 is structured to meet the needs of customers who have high volume copying requirements. For example, in the commercial airline manufacturing industry, operation and maintenance manuals may contain thousands of pages and normally must be updated and reproduced frequently, such as every three months. An updated set of manuals may be issued to airline customers for each airliner in use.

The present invention is especially useful for application in copy systems designed for high copy-volume usage. In the preferred embodiment described herein, the copy system is provided in the form of a 9900/60+ xerographic duplicator manufactured by the Xerox Corporation.

The copy system 10 further includes a control system 16 that is structured to operate and control the copy system 10 in accordance with the principles of the invention. The control system 16 includes an engine control 18 for the duplicator 12 and a sorter control 20 for the multi-tower sorter 14. A sorter communications interface 22 links the controls 18 and 20 to provide coordinated control and operation of the duplicator 12 and the sorter 14.

SYSTEM APPARATUS

In FIGS. 2–4B, duplicator apparatus 24 (corresponding to the duplicator 12) and sorter apparatus 26 (corresponding to the sorter 14) for the Xerox 9900/60+ unit are illustrated in greater detail and will be described herein to an extent that facilitates development of an understanding of the present invention.

Accordingly, the duplicator apparatus 24 employs an automatic document handler (ADH) 30 which automatically inverts and feeds an original document onto a platen glass 32 with proper registration against a registration edge. Original documents can also be placed manually on the platen glass.

Four xenon lamps 34 are flashed to illuminate the original document on the platen glass 32. In turn, mirrors 36 and 38 reflect an image of the original document through lenses 40 which transmit a focused image to the surface of a photoreceptor belt 42. Electric charge is applied to the belt 42 by a charge corotron 44.

Brighter areas of the reflected image discharge the underlying areas of the belt 42, while darker image areas of the belt 42 remain charged. Lamps 46 are employed to discharge the belt edge areas and the belt areas between copies to reduce dry ink consumption and to keep the duplicator 24 clean.

Five magnetic rollers 48 brush the belt 42 with a positively charged steel developer which carries negatively charged dry ink. Positively charged areas of the belt 42 attract the negatively charged dry ink to form a dry ink image. A lamp and a corotron 50 loosen the dry ink image for transfer to copy paper.

Copy paper is obtained from one of three sources. Thus, a main tray 52 or an auxiliary tray 54 supplies paper for the copying process. A duplex tray 56 refeeds paper with first-side image for second-side imaging in a duplex mode in which two-sided copies are produced.

The dry ink image is transferred to a sheet of copy paper after the paper is transported over belt 58 and as it passes between a bias transfer roller/transfer corotron 60 and the photoreceptor belt 42. A detack corotron 62 strips the paper from the belt 42 after image transfer. The copy paper next passes through a roller section 66 where a pressure roller applies pressure to the paper and a heat roller melts the dry ink into the copy paper.

A lamp, corotron, and brush 64 clean the photoreceptor belt 42 for the next copy.

When the copy paper reaches a turnaround station 68 in the simplex mode, the paper is transported over path 70 for delivery to the sorter 26. In the first pass in the duplex mode, the paper is inverted into the station 68 and then is returned over path 72 to the duplex tray 56 for a second pass in which the second paper side is imprinted with the second side image. After the second pass in the duplex mode, the paper is sent from the station 68 over the path 70 to the sorter 26.

A xerographic maintenance module 74 is used by the operator or a service representative to adjust xerographic voltages and currents to specifications.

Figure 3:
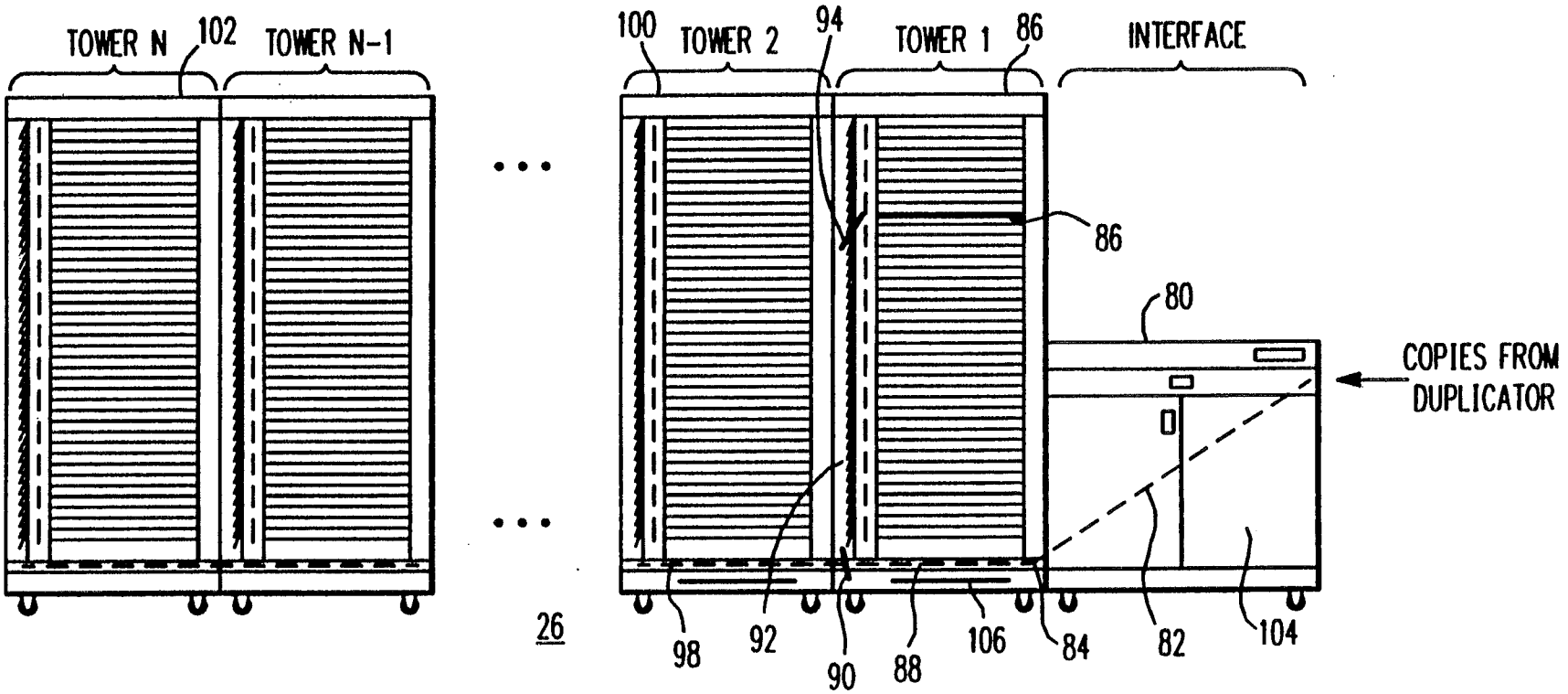
FIG. 3 is an elevational view of a sorter included in the copy system of FIG. 1.

As shown in FIG. 3, copy sheets are delivered along the sorter paper path from the duplicator 24 to an interface module 80 between the duplicator 24 and the sorter 26. In the module 80, sheets proceed down a incline transport 82 to an entry level 84 for a first sorter tower 86.

Figure 4A:
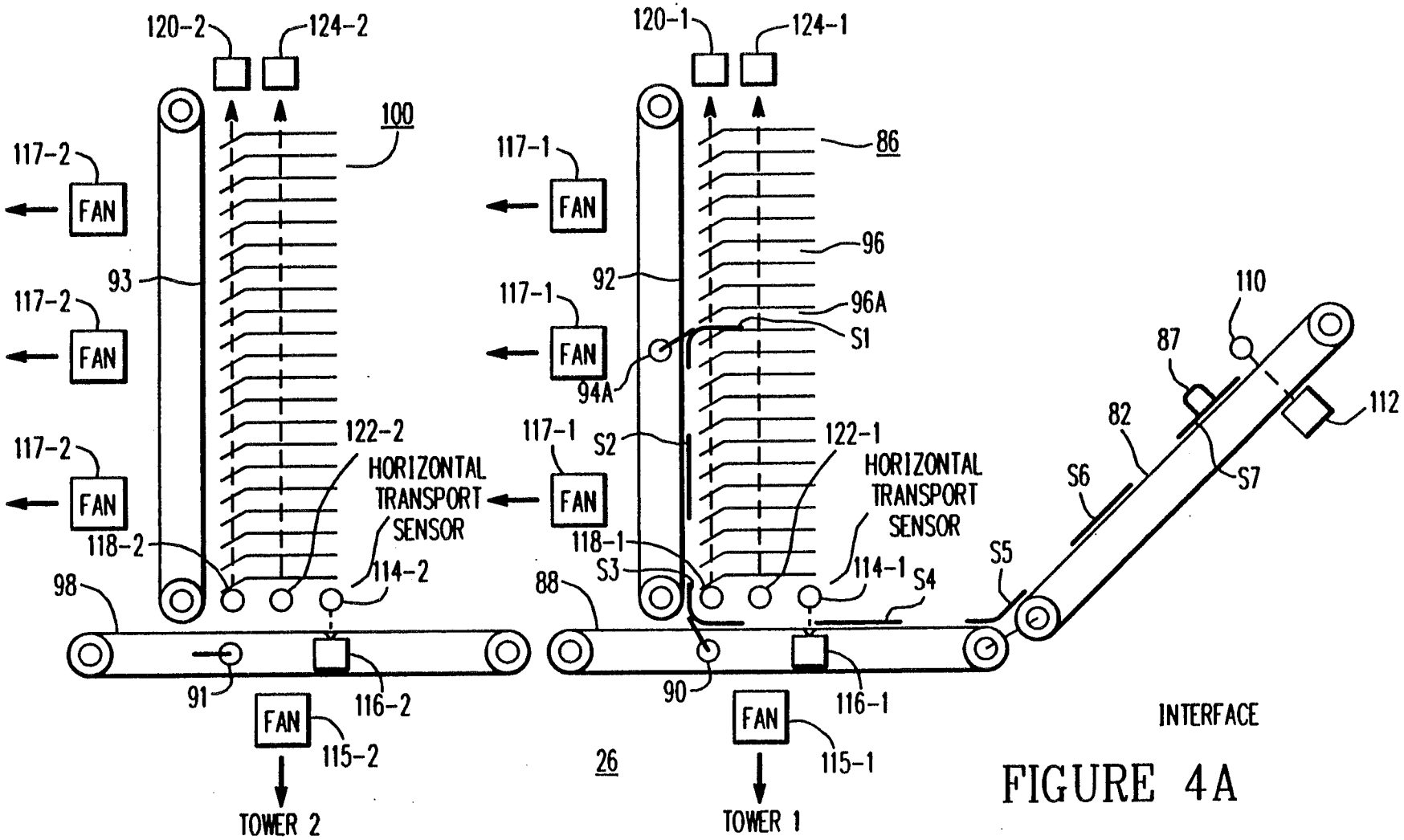
FIG. 4A shows an enlarged, generally schematic view of towers in the sorter of FIG. 3 along with interface apparatus connected between the duplicator and the sorter.
Figure 4B:
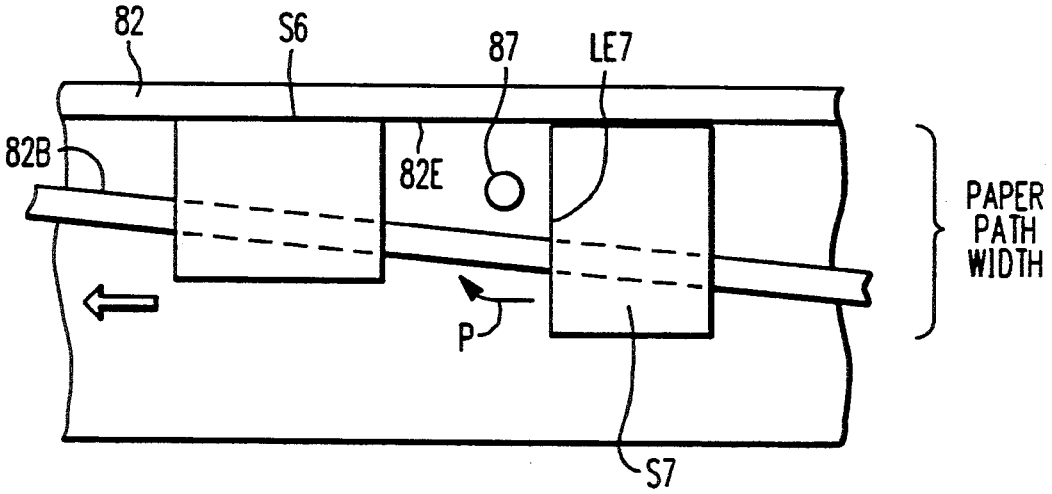
FIG. 4B is a partial top plan view of an incline transport employed in the interface apparatus of FIG. 4A.

As indicated in FIGS. 4A and 4B, a pivoting force P is applied to each copy sheet just after entry to the incline 82 by rotator means such as a spinner device 87. The spinner 87 is mounted (FIG. 4A) inboard of the paper path and off-center in relation to a leading long dimension edge LE7 of sheet S7 and projects upwardly (FIG. 4A) beyond the plane of a incline ball-on-belt system 82B thereby acting as an obstacle to the sheet S7 and imposing the pivoting force P against the leading edge of the sheet S7.

The sheet S7 thus pivots in its plane so that the long sheet edge LE7 moves toward alignment with a metallic registration edge 82E along the length of the incline. The ball-on-belt system 82B is skewed toward the registration edge 82E thereby quickly directing the pivoting sheet S7 into registration with the registration edge 82E as the sheet S7 continues downwardly inclined movement on the incline transport 82. The weight of distributed balls (not shown) holds the sheet against an underlying skewed belt (not shown) thereby providing added continuing registration force on the sheet S7. Sheet S6 is ahead of the sheet S7 and is shown as having its long edge LE7 registered against the incline edge 82E and thus properly oriented for entry to the sorter 14.

A horizontal transport 88 delivers each sheet to a vertical deflector gate 90 which, if actuated, deflects the sheet to a vertical transport 92 for upward travel in the first tower 86. When the sheet encounters an actuated bin deflector 94A, the sheet is deflected horizontally into the associated bin 96.

If the vertical deflector gate 90 is deactuated when a sheet reaches it, the sheet continues over a horizontal transport 98 in a second tower 100 and like horizontal transports in each successive tower until a tower with an actuated vertical deflector gate like the gate 90 is encountered. The sheet is then deflected upwardly in that tower for routing to the selected bin. An overflow catch tray (not shown) is provided at the output of an Nth tower 102 if no vertical deflector gate in any of the sorter towers is actuated.

In FIG. 4A, the first two towers 86 and 100 of the sorter 26 are shown in somewhat greater detail. The interface incline transport 82 includes an interface paper path sensor preferably in the form of an optical pair that includes an LED device 110 and an optical sensor 112. Paper sheets such as the sheets S6 and S7 are held, as previously described, against the incline belt surface and properly oriented by the bell-on-belt system 82B.

As a sheet such as sheet S5 is transferred to the horizontal belt system 88 for the first tower 86, it is held against the horizontal belt surface in proper position by a pressure differential produced across the horizontal belt by fan means 115-1. Another paper sensor preferably in the form of an optical pair 114- 1 and 116-1 operates as a horizontal paper transport sensor in the tower 86.

When a sheet such as sheet S3 reaches the vertical deflector 90 in its actuated position, the sheet S3 is deflected upwardly in the first tower 86 and transferred to the vertical belt system 93. A sheet such as sheet S2 is held in proper position against the vertical belt surface by a pressure differential produced across the vertical belt by fan means 117-1 three fans in the preferred embodiment.

The vertical transport belt 92 drives each sheet upwardly until an actuated bin deflector such as deflector 94A is encountered. The sheet such as sheet S1 is then directed into the associated bin, i.e. bin 96A.

An optical pair sensor 118-1, 120-1 is employed in the tower 86 to detect paper entry into a bin. Another optical pair 122-1,124-1 generates a signal when the tower 86 is empty.

Other towers in the sorter 26 include optical sensor pairs, deflectors, transport belts, and fans like those described for the tower 86. A vertical deflector 91 in the second tower 100 is shown in the unactuated position. Other elements like those in the first tower 86 are designated by reference characters corresponding to the reference characters used for the same elements in the first tower 86.

When a copy job is started, sorting system status data is sent to the copy engine control system 18 (FIG. 1). Specifics of how sorting is to be done, in terms of bin sequencing, tower selection and operating mode, are established in the copy engine of duplicating control system 18. The specifics including job parameters, sorter start and stop commands, and handling instructions for delivered copies, are communicated to the sorter control system 20.

In the preferred embodiment, the sorter control 20 is located on a system control board in the interface module 80 as indicated by the reference character 104. A common cable (not shown) connects the system control board 104 to a tower logic board in each tower. Only one tower logic board 106 is shown in FIG. 3. As more fully explained subsequently herein in the general and detailed description of the control system 16, the sorter and tower controls monitor and operate electrical devices in the towers to achieve sorter and copy system performance in accordance with the present invention.

In implementing the present invention in the preferred embodiment, the following information is sent from the copy engine or duplicator control 18 to the sorter control 20:

Command: "Sorter Run"
Instructs the sorting system to turn on drive systems as required.

Command: "Sorter Stop"
Instructs the sorting system to turn off all drive systems.

Data: "Specify Job"
Describes all attributes of the job to the sorting system

Command: "Initialize Sequence"
Instructs the sorting system to start at the first bin the job will use.

Sorter status data includes number of towers, identity of any offline towers, available bins, and empty status of each bin. The duplicator control system 18 includes job segment size and other job parameters from sorter status data and job options selected by the operator.

Command: "Request Available Towers and Bins"
Asks the sorting system to send a message that indicates what resources are available.

Command: "Request Required Towers and Bins for Distribution Job"
Asks the sorting system to send a message that indicates resources required for Distribution job.

The following information is preferably sent from the sorter control 20 to the copy engine or duplicator control 18:

Data: "Towers and Bins Available"
Describes what tower and bin resources are available, indicates empty and offline status.

Data: "Required Towers and Bins for Distribution Job"
Describes what tower and bin resources are required for a Distribution Job.

Data: "Copy Sorted"
Indicates that a copy has entered a bin, used for job integrity control Data: "Sorting System Jam"
Indicates that a jam has occurred in the sorting system.

Data: "Sorting Jam Cleared"
Indicates that the current jam has been cleared.

Data: "Sorter Empty Status"
Indicates which towers are empty and which are not.

With reference again to the copy control system 16 in FIG. 1, an operator interface control 140 is provided for the copy engine or duplicator control system 18. A keypad 142 enables an operator to enter job setup and other data. Job status and other data are shown on a display 144.

Figures 1, 5A:
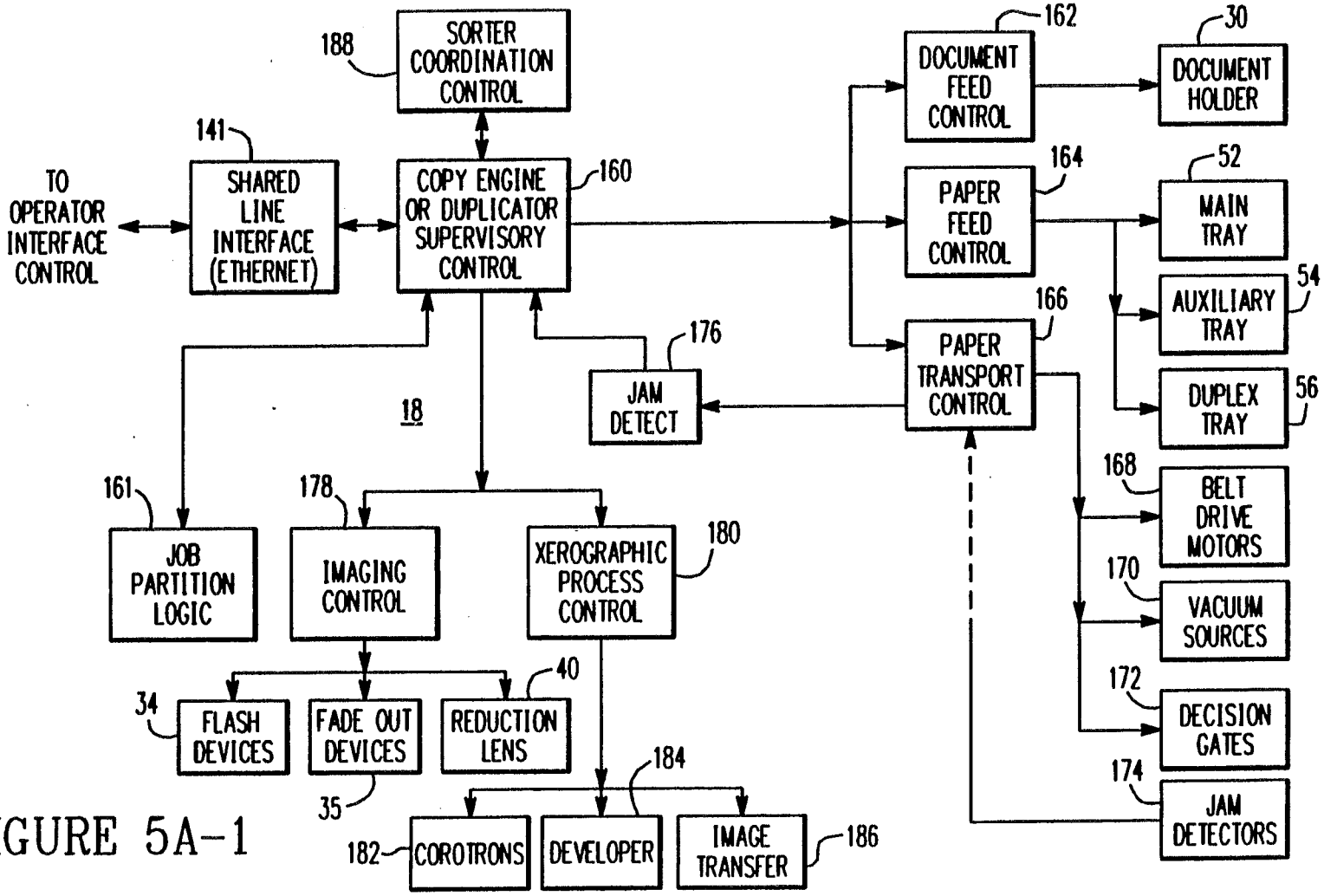
Figures 2, 5A:
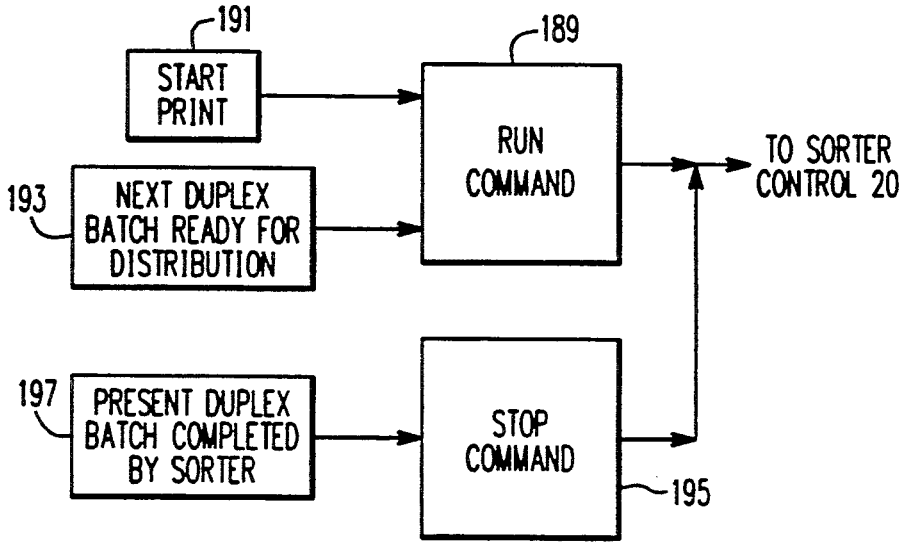
Figure 5B:
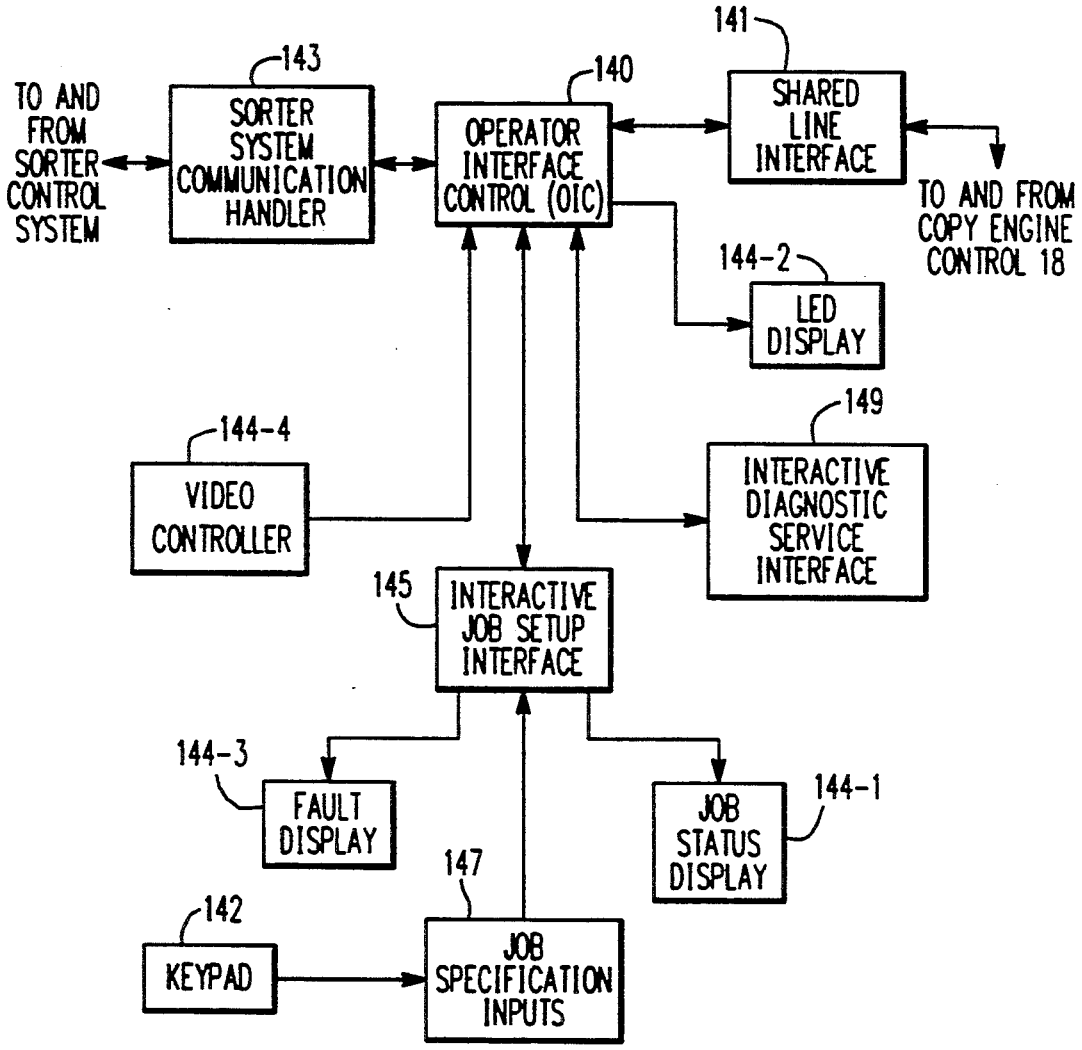
FIG. 5B is a more detailed functional block diagram for an operator interface control employed in the duplicator control of FIG. 5A1.

The operator interface control (OIC) 140 is illustrated in greater detail in FIG. 5B. An OIC screen includes display 144-1 which shows the status of a running job and display 144-3 which shows any faults that occur during the running mode. A video controller 144-4 controls the writing of information on the OIC screen. LED display 144-2 shows the copy quantity and other data.

In the operating mode, interactive job setup software 145 is provided a part of the OIC 140 to process job specification inputs 147 entered by the operator through the keypad 142. A sorter system communication handler 143 handles command and data transmissions to and from the sorter control system 20 after a job setup is completed and the job is started. When the copy system 10 is placed in a diagnostic mode, interactive diagnostic service software 149 is provided to process diagnostic inputs entered by a technical representative in the process of running diagnostics on the system.

Job selection parameters entered by the operator are processed by the OIC 140 for use during software execution in the control and coordination of the copying and sorting processes. Job selection parameters include:

Copy Quantity

Mode — 1 side to 1 side, 1 side to 2 sides, 2 sides to 1 side, 2 sides to 2 sides Output — top tray, uncollated sorter, collated sorter, collated supplement, special distribution Starting Bin Starting Tower Number of Bins Per Set Capacity of Bins — collated mode Capacity of Bins — uncollated mode Bin Skip Mode Towers in Limitless Sorting After First Pass — single, multiple Once a copy job has been entered into the copy system 10 and original documents are placed in the original document holder 30 (FIG. 2), the copy engine or duplicator control 18 (FIG. 1) operates the copy engine 12 or duplicator 24 (FIG. 2) through control devices 146 and executes the programmed job. The sorter control 20 is coordinated to operate the sorter 14 in accordance with the job requirements and in accordance with the present invention as more fully described hereinafter.

Sorter coordination is achieved through the transmission of commands and data from the duplicator control 18 through the OIC 140 and sorter communication interface 22 to the sorter control 20. Data is also sent from the sorter control 20 through the sorter communication interface 22 and the OIC 140 to the duplicator control 18 to facilitate coordinated system operation. The transmitted commands and data are preferably those described previously herein for the preferred embodiment.

As indicated by reference character 148 (FIG. 1), copy sheets are transported from the duplicator output to the transport interface 80 which is operated by control devices 150 under the control of the sorter control system 20. The copy sheets are then transported to the towers 86, 100, 102, etc. as indicated by reference character 152 and as described in connection with FIGURE 3.

A tower control 86C, 100C, 102C, etc. is provided for each tower in the sorter 14. In the Xerox 9900/60+ duplicator, the sorter 14 can include up to 10 towers with each tower having sixty bins.

The sorter control 20, under duplicator control commands, operates through a tower communications interface 154 to direct the tower controls in operating the towers in accordance with the present invention and in accordance with system and programmed job requirements.

Each of the controls at the various control levels preferably includes a programmable microcomputer (not specifically shown). In the present embodiment, for example, each of the various controls preferably includes a microprocessor chip as follows:

duplicator control 18 — Intel 8085

OIC 140 — Intel 8085 sorter control 20 — Intel 8088 each tower control — Intel 8051

COPY ENGINE OR DUPLICATOR CONTROL SYSTEM

Figure 2:
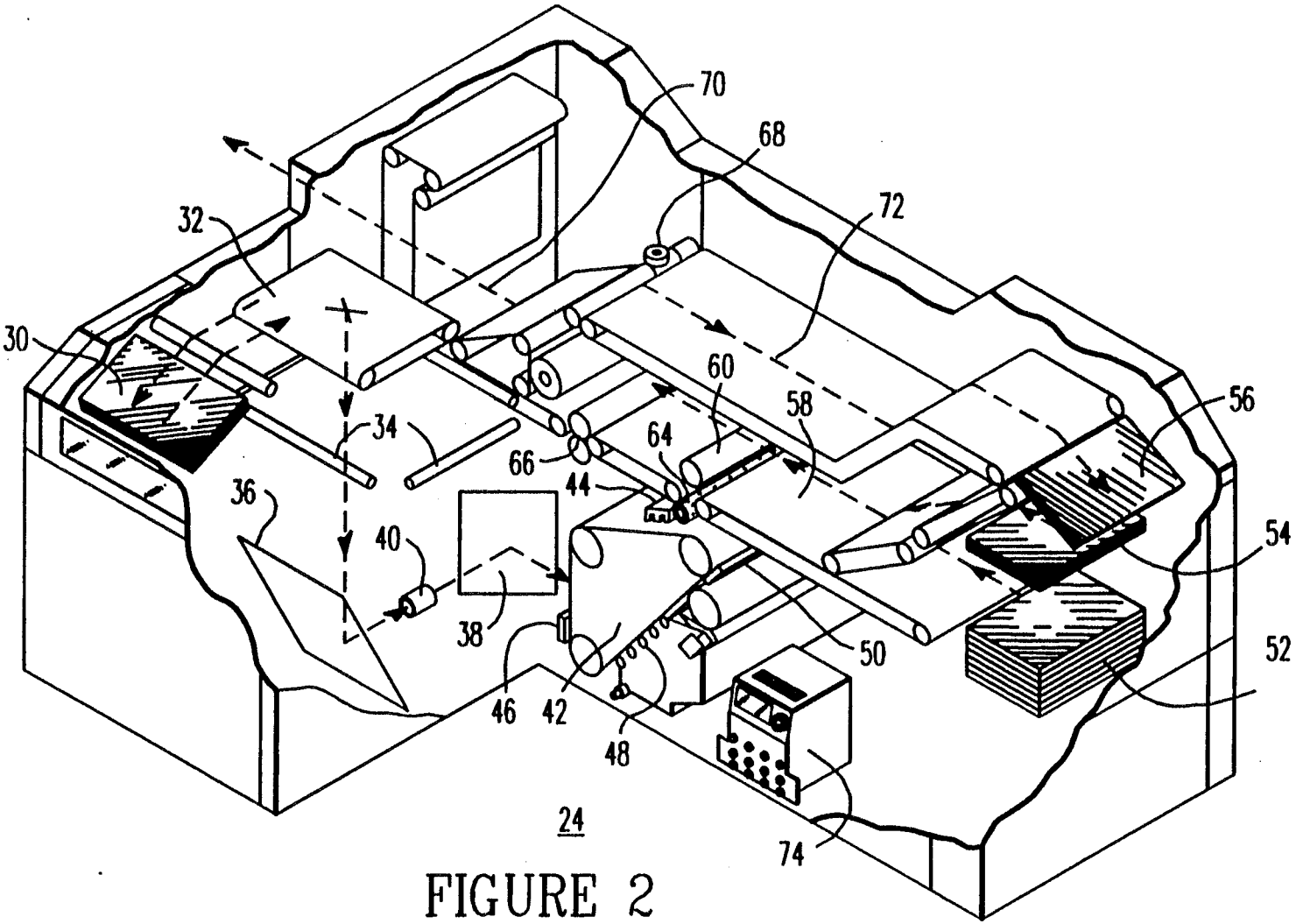
FIG. 2 shows a perspective view of a copy engine or duplicator that is included in the copy system of FIG. 1 and that is partially broken away to show how copies are produced from original documents.

The duplicator control 18 is shown in greater detail in FIG. 5A-1. Generally, the duplicator control 18 directs and coordinates the operation of the duplicator 24 through basic control functions including document and copy paper feed and transport control, image generation control, and image transfer and fusing control (xerographic process control). Various control devices, described in connection with the duplicator apparatus 24 of FIG. 2, are operated under sequencing and logic control by the duplicator control 18 in executing these basic control functions.

Input data defining the current copy job is transferred through the shared line (ethernet) interface 141 to a supervisory control level 160 of the duplicator control 18 from the operator interface control 140. Where a programmed job exceeds the system resources, programmed job partition logic is employed by the duplicator control 18 to divide the job into sub-jobs which individually are appropriate to the system resources and which taken together constitute the programmed job. Job factors considered in the partitioning logic include: copy quantity, copy mode (simplex, duplex, etc.), duplex tray capacity, and sorting capacity.

A document feed control 162 operates a document belt drive and other document feed devices to transfer original documents sequentially from the original document holder 30 to the platen glass as successive copy operations are completed. A copy paper feed control 164 similarly operates paper feed devices associated with the operator selected tray 52, 54 or 56.

As successive copy sheets are fed to the copying process, a paper transport control 166 operates various belt motors 168, vacuum sources 170 and decision gates 172 along the paper path as required to execute each copying operation within the duplicator machine 24. Strategically located jam detectors 174 signal the paper transport control 166 if a paper jam occurs. The supervisory control 160 is also signaled as indicated by reference character 176 and then initiates appropriate action.

An imaging control 178 controls the flash units 34, fade out devices 35 and the reduction lens 40 in producing an image on the photoreceptor belt 42. A xerographic process control 180 operates various corotrons 182, developer apparatus 184, and image transfer devices 186.

A sorter coordination control 188 generates SORTER RUN and SORTER STOP commands as inputs to the sorter communications interface 22 in step with the start and end of copy sheet output from the duplicator 24. The sorter coordinator 188 also collects data that describes all attributes of the current job and transmits such data to the sorter control 20. The sorter coordinator 188 further initializes the sorter control 20 to start at the first bin that will be used by the job.

SORTER CONTROL SYSTEM

As shown in FIG. 5A-2, a SORTER RUN command 189 is generated in response to entry of a START PRINT signal 191 by the operator or when a NEXT DUPLEX BATCH READY logic signal 193 is generated after a previous duplex batch has been completed by the sorter 14. A STOP command 195 results when the present duplex batch is completed by the sorter 14 as indicated by block 197.

The sorter control 20 transmits data on towers and bins availability and requirements in response to command requests from the sorter coordinator 188. As listed previously herein, other data transmitted to the sorter coordinator from the sorter control 20 includes jam data, sorter status and copy sorted.

Sorter data is received by the OIC 140 and processed into a data base of sorter status information. The sorter data base is used by the duplicator control system 16 in the execution of control software that controls and coordinates the copying and sorting processes.

The sorter control 20 and associated tower controls are shown in greater detail in FIGS. 6A–6B and 7A–7C. In addition to inputs from the sorter communications interface 22, inputs 190 are applied from a keypad and the interface downramp entry sensor 110 112 (FIG. 4) to the sorter control 20. An interface control display 193 displays running job data such as the tower bin scheduled to receive the next copy and the number of copies in that bin. In the diagnostic mode, keypad entries are made and the display 193 generates information that results during operation of the interactive diagnostic process.

An interface transport control 194 provides on/off control for the interface transport 82 through a downramp drive motor 196 as a function of signals from the downramp entry sensor 110, 112. Diagnostic logic 198 is employed by the operator or service person to test sorter operation and to resolve fault conditions.

Figure 6B:
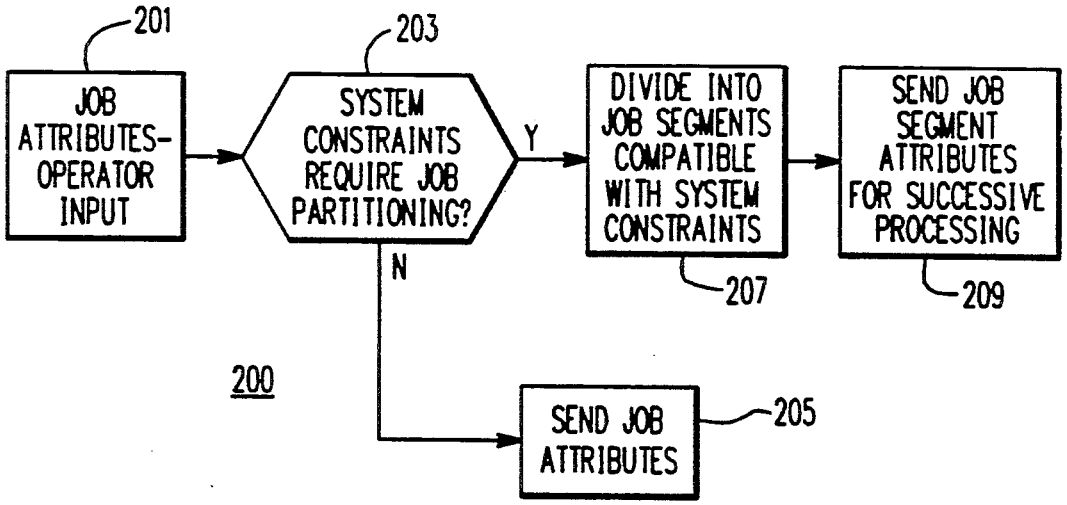
FIG. 6B is a functional block diagram representing programmed processing of copy job attributes in the duplicator and sorter control systems.

A tower allocation logic control 200 is employed by the sorter control 20 to modify commands from the duplicator control 18 and develop respective tower commands that specify requirements for coordinated operation of the towers in distributing output copies from the duplicator 24 and completing the current job. As shown in FIG. 6B, the logic control processes job attributes 201 that have been input by the operator and determines in test block 203 whether system constraints require the specified job to be divided into sub-jobs. If not, block 205 transmits the job attributes for tower processing.

If partitioning is required, block 205 divides the job into job segments each of which is compatible with system constraints. The attributes for the computed job segments are sent to the tower controls one-by-one until the job segments are successively completed, at which time the whole job as specified by the operator is completed.

Figure 6A:
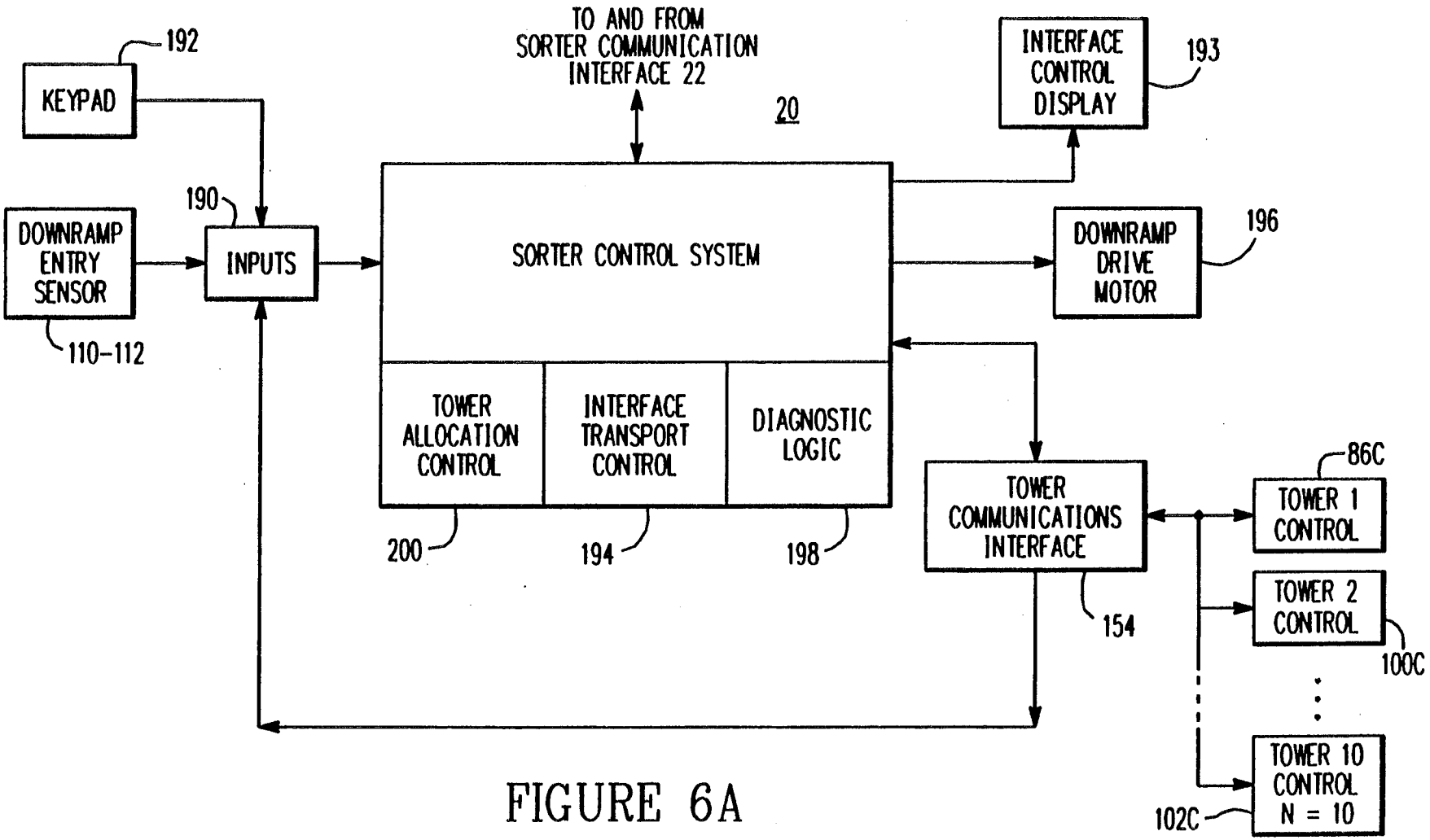
FIG. 6A shows a functional block diagram of a control system for the sorter of FIG. 3.

Tower commands are transmitted to the respective tower controls 86C, 100C, 102C, etc. through the tower communications interface 154. As a specific example, the Nth tower control in FIG. 6A is designated as the tenth tower control which corresponds to the maximum number (10) of towers that the Xerox 9900/60+ can currently accommodate. Tower controls 3 through 9 are not shown in FIG. 6 since they are like the illustrated tower controls.

Figure 7A:
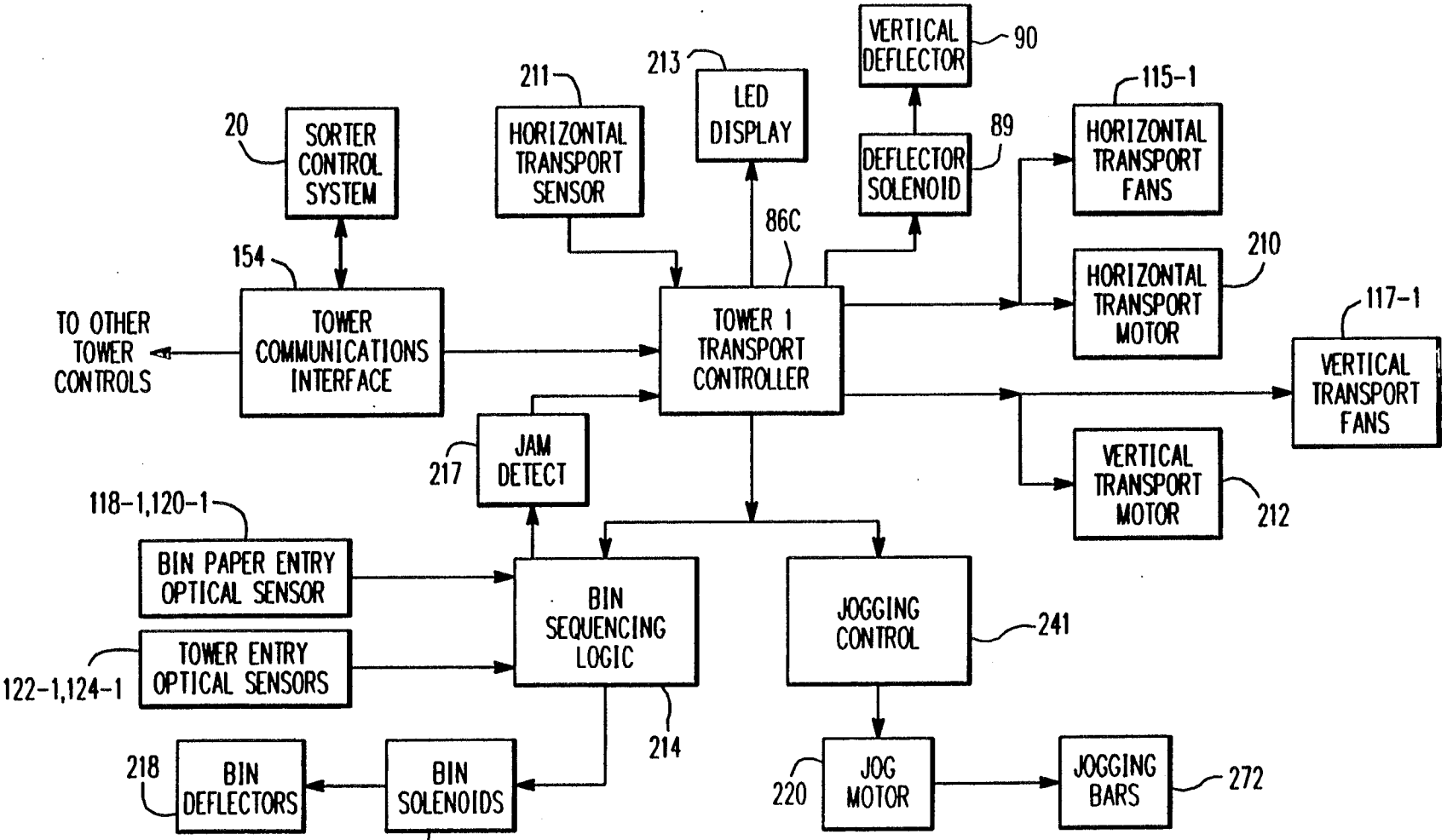
FIG. 7A shows a functional block diagram of a control system that is provided for each tower in the sorter.

More detail is shown for the tower control 86C in FIG. 7A. Other tower controls have like detailed structural content.

Commands for the tower control 86C from the sorter control 20 specify tower start/stop, tower sequencing based on copies to be delivered to each bin. It is also preferred that a START signal for the horizontal transport for the next available tower, such as the tower 100, be sent to the control for that tower so that it is ready in the event paper flow is diverted from the tower 86.

Figure 7B:
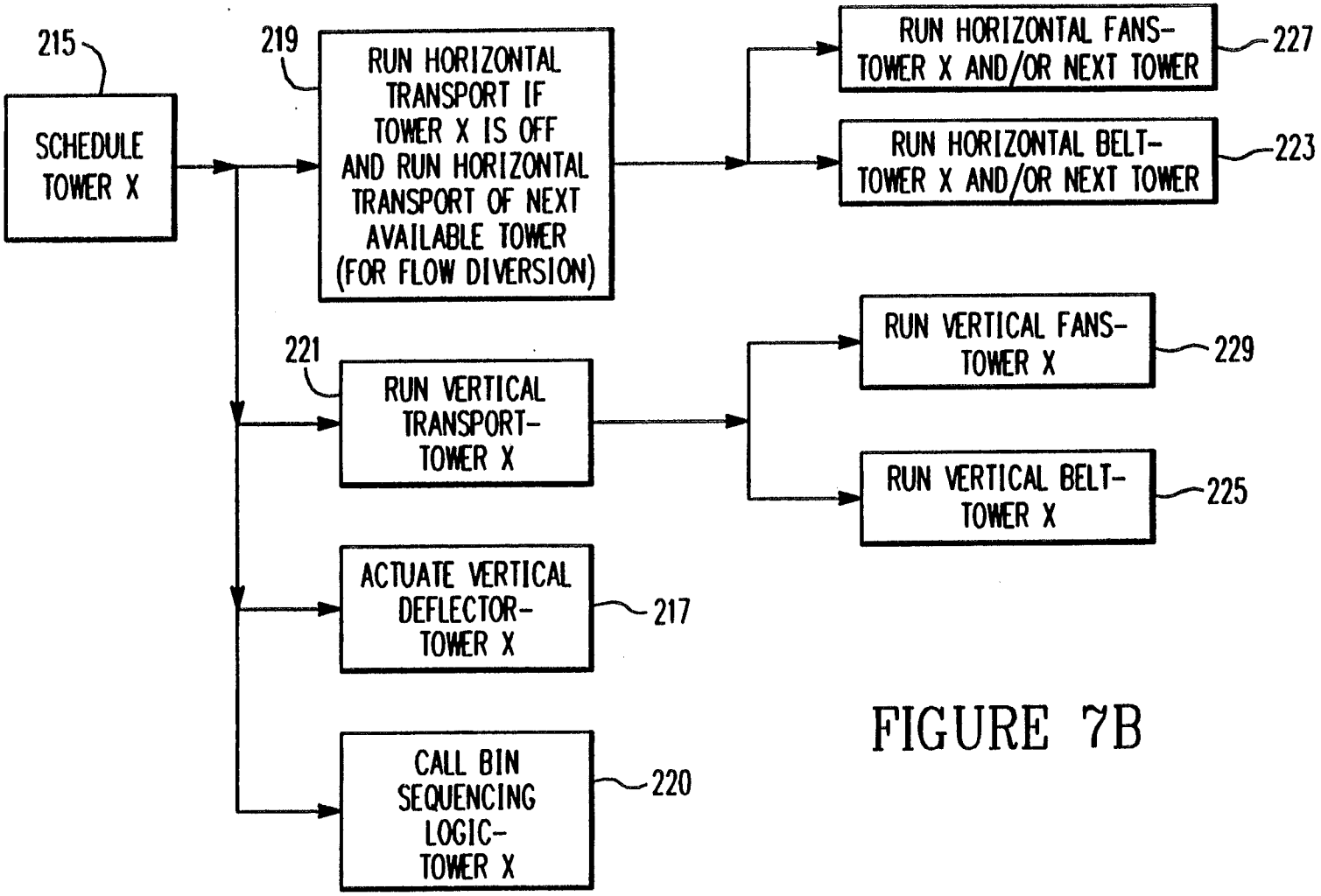
FIG. 7B illustrates programming employed in the tower control to operate the tower mechanical devices.

Reference is now made to FIG. 7B as well as FIG. 7A. If a tower X, such as the tower 86, is to receive copies as indicated by block 215, block 217 actuates a solenoid 89 to operate the associated vertical deflector 90. Blocks 219 and 221 start the associated horizontal and vertical belt motors 210 and 212 under direction from blocks 223 and 225 and the single horizontal fan 115-1 and the three vertical fans 117-1 are started under direction from blocks 227 and 229. In addition, the horizontal transport for the next available tower is started by the block 223 as previously indicated.

After the bin sequence for the tower 86 is completed, the vertical transport 92 (FIG. 4) is turned off and the associated vertical deflector is deactuated. Since subsequent sheets are to pass through the tower 86 to the next available tower such as the tower 100, the horizontal belt motor 210 for the horizontal transport 88 and the horizontal fan 114-1 are kept running. A horizontal transport sensor signals the horizontal transport status to the tower control 86C. LED displays 213 indicate when the tower is empty and when a paper jam has occurred in its operation.

The bin sequence is controlled by bin sequencing logic 214 which actuate bin solenoids 216 to operate bin deflectors for successive bins in accordance with the scheduled bin sequence. Copy sheets transmitted in a copy sheet stream from the duplicator 24 are thereby distributed in the sorter 14 in accordance with commands and attributes received from the sorter control system 20 with feedback regulation provided by signals from the bin entry sensors 118-1, 120-1.

Additional bin status data is supplied to the bin sequencing logic 214 by the tower empty sensor 122-1, 124-1. Such data is provided for LED display and transmitted to the duplicator OIC 140 for its status data base.

Any jam detected by jam detection logic 217 on the basis of feedback signals from bin and tower entry sensors is transmitted to the tower control 86C for appropriate action, such as a sorter shutdown followed by a job redefinition for restart after the jam is cleared.

Figure 7C:
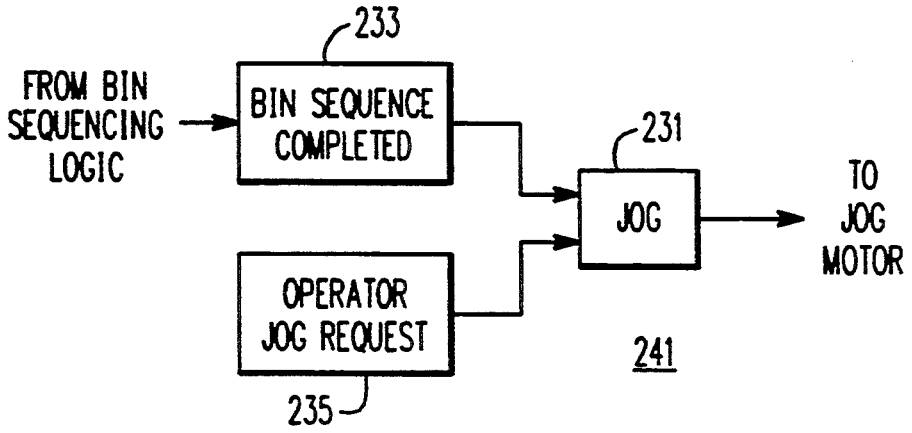
FIG. 7C shows program logic employed to control paper jogging bars in the towers.
Figure 7D:
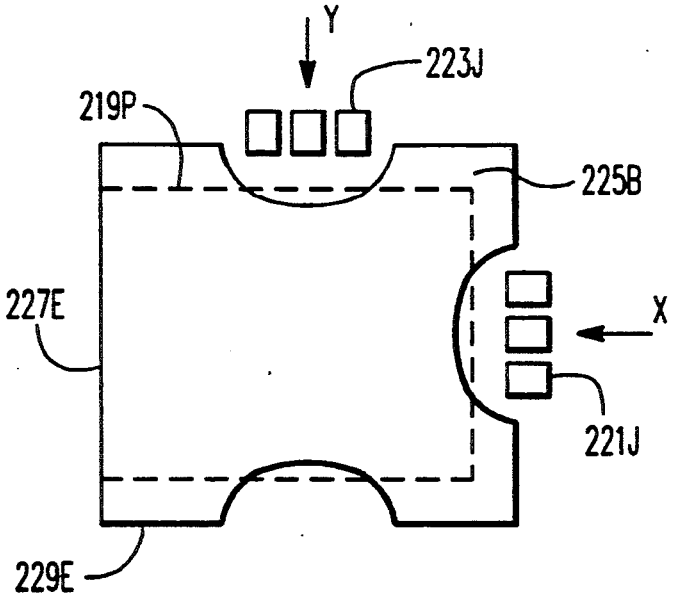
FIG. 7D is a schematic top plan view of the base of a tower bin along with jogging bars employed to push paper copies into an aligned stack within the bin.

A jogging control 241 operates a tower jog motor 220 to drive jog bars 221J and 223J (FIG. 7D) along X and Y axes to shuffle sheets into alignment in each bin in a tower such as the tower 86. A sheet of paper 219P delivered to a bin and located on bin base 225B is pushed against bin edges 227E and 229E by the jog bars 221J and 223J and thus aligned with previously jogged underlying sheets. As shown in FIG. 7C, such jogging is programmed in block 231 to occur when block 233 indicates completion of the bin sequence for the tower or when block 235 signals an operator initiated jog, and when copies are being distributed to another tower.

COPY SYSTEM OPERATION IN THE UNCOLLATED DUPLEX MODE WITH EFFECTIVE STACK SEPARATION PROVIDED IN THE SORTER

The copy system 16 (FIG. 1) operates in the uncollated duplex mode when the operator enters the uncollated and duplex mode selections through the operator interface control 140. In this case, the number of multiple copies that can be made of each sequenced original is limited by the capacity of the duplex tray 56 (FIG. 2). The duplex tray capacity in the preferred embodiment is 100.

In accordance with the present invention, the operation of the copy system 10 is managed in the uncollated, duplex mode so that the output copies are sorted efficiently. Specifically, output copies are distributed in a manner that avoids operator confusion especially where a relatively high copy quantity has been requested by the operator.

As indicated previously, conventional sorting in typical lower volume duplicator processes results in the copies for each original being divided into multiple logical bins that are separated from each other with copies of other originals located in bins in the space between the separated logical bins. This copy distribution arrangement is confusing to the operator when the copy work is done and the bins containing like copies so that a single stack of like copies can be formed for each original.

Figure 8A:
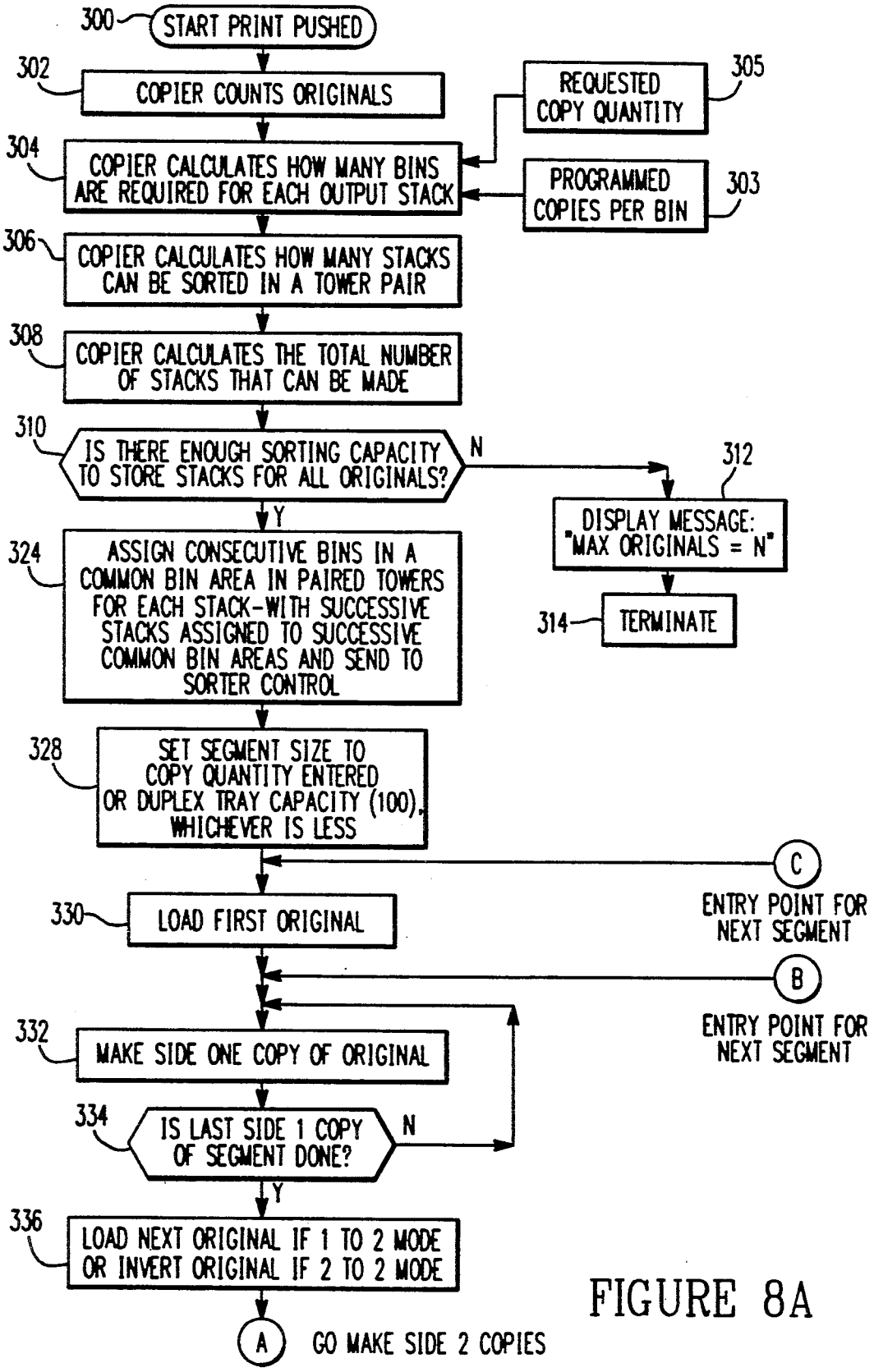
FIGS. 8A and 8B show a flow chart that represents the manner in which the duplicator is controlled in the uncollated duplex mode to enable the copy system to produce better sorting in high-volume copy work in accordance with the present invention.
Figure 8B:
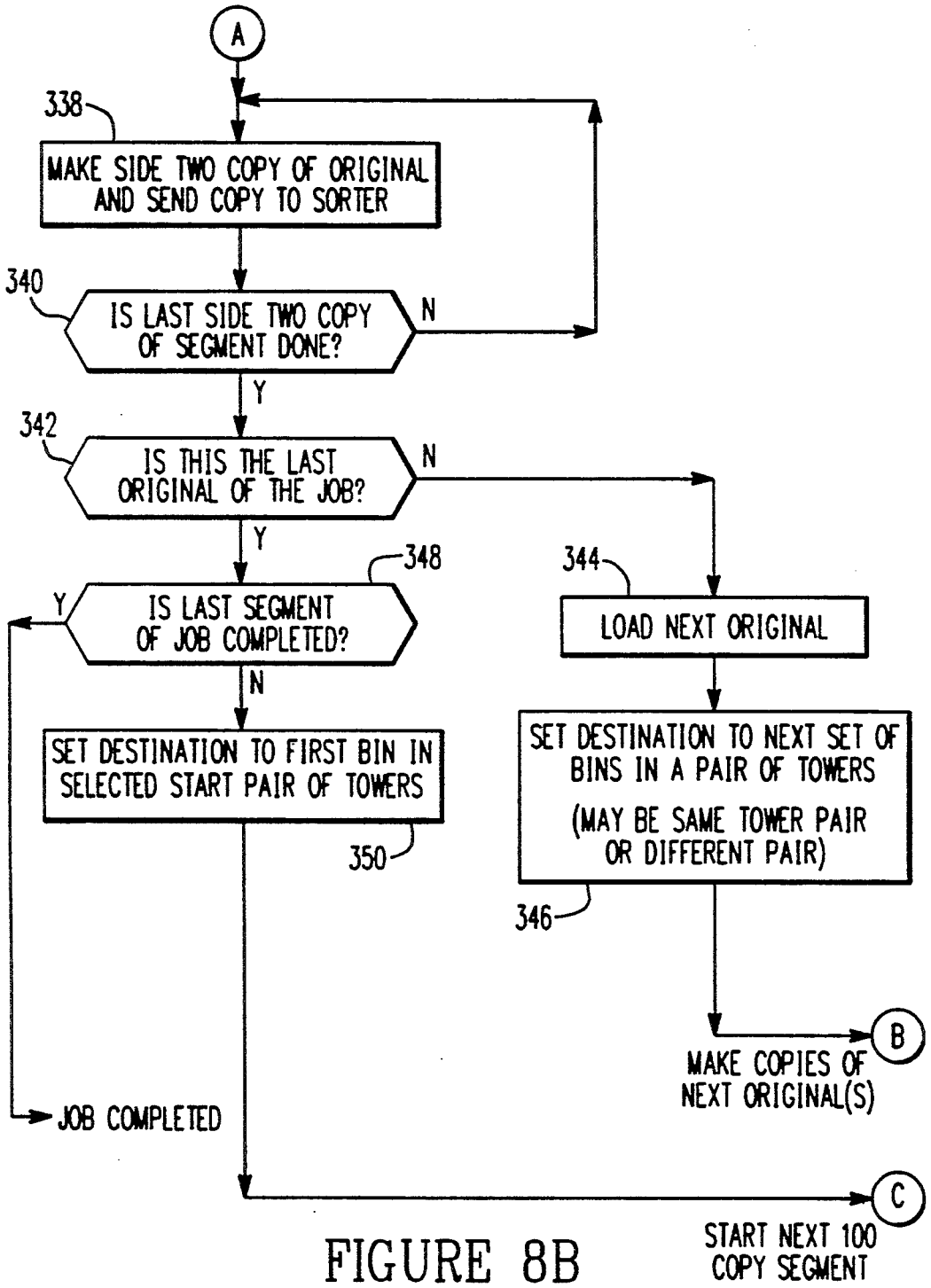
Figure 8C:
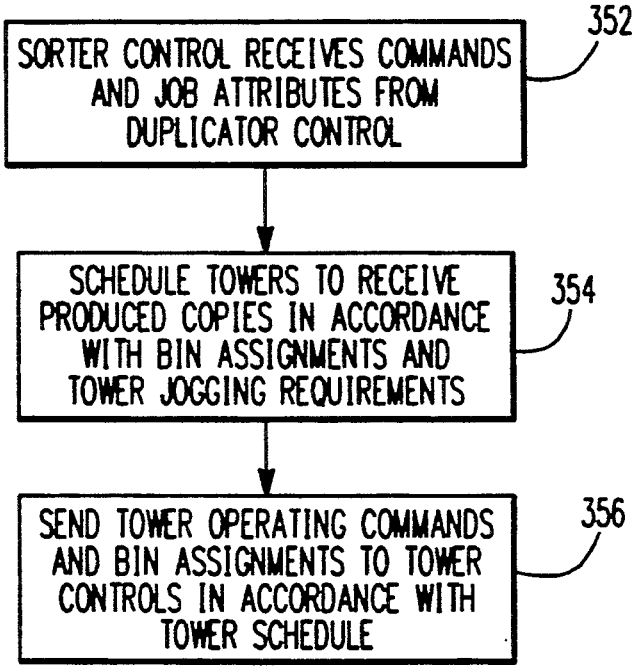
FIG. 8C shows a flow chart representing the operation of the sorter control in implementing tower and bin assignments for output copies under direction of the duplicator control.

In FIGS. 8A and 8B, a flow chart specifically illustrates the operation of the copy system 16 in providing improved system performance in the uncollated duplex mode in accordance with the invention. With the copy engine 12 (FIG. 1) or the duplicator 24 (FIG. 2) and the sorter 14 started, the duplicator 24 responds to a signal from the start print button as indicated by reference character 300 to execute block 302 which counts the number of originals in the original document handler.

Generally, the sorting resources needed for the job being processed must be determined at the start of the job since all of the loaded originals will be copied in the selected quantity. The microprocessor included in the duplicator control 160 (FIGURE 5A-1) calculates the sorter resources from feedback status data from the sorter control 20 (FIG. 6A) and job specifiers programmed by the operator.

Next, functional block 304 determines how many bins are required for each output stack from the programmed bin capacity and the requested number of copies. In block 306, a calculation is made of the number of stacks that can be sorted in a tower pair.

It is preferred in the present embodiment that each output stack be collected in a pair of towers so that copies collected in one tower can be jogged into alignment as additional copies are being delivered to the other tower. Since a 5 second jogging cycle is needed in the preferred embodiment for effective jogging and since the copy production rate is two per second, a minimum of ten copies are delivered to ten successive bins in a first tower and the first tower is jogged as the next ten copies are delivered to ten successive bins in the other paired tower.

The total number of stacks that can be made is computed in functional block 308, and test block 310 determines whether enough sorting capacity exists to store copy stacks for all originals. If there is insufficient capacity, a maximum number of originals is calculated and displayed by block 312 before termination in block 314.

When the sorting capacity for the currently entered job is determined to be sufficient, functional block 324 assigns consecutive bins in paired towers so that copies in a complete copy stack for each original are delivered to consecutive bins in a common bin area and preferably so that consecutive stacks are collected in consecutive bin areas. The bin and tower assignments are sent to the sorter control 20 during the copying process.

With reference again to the flow chart in FIG. 8A, job partitioning is performed by functional block 328 which sets the segment size to the copy quantity entered or to the duplex tray capacity (100 in this preferred embodiment) whichever is less. Accordingly, the copy system 10 is ready for execution of the copying process.

The first original is loaded by the document handler as indicated by block 330 and side one copy of the original is made as indicated by block 332 and sent to the duplex tray 56. Test block 334 directs additional copies to be made of the current original until the required number for the set segment size are made.

Block 336 then loads the next original if the 1-to-2 mode has been selected, or the current original is inverted if the 2-to-2 mode has been selected. Side two copy of the original is next made on side 2 of a sheet received from the duplex tray 56 and then sent to the sorter 14 as indicated by functional block 338.

Test block 340 directs repeat operation of block 338 to make side two copies on successive sheets from the duplex tray 56 and send such sheets to the sorter 14. When the last side two copy of the segment is made for the current original, test block 342 determines whether the last original of the job has just been processed.

If not, block 344 loads the next original and block 346 sets the sorter destination for the stack of copies of the next original by transmitting to the sorter control 20 the tower and bin assignments. As the process continues, additional paired towers may become assigned for delivery of produced copies. As indicated by chart linker B, the programming executed for the first segment is repeated for the second and successive originals until the last original of the job is completed.

When the last original is completed, test block 348 checks whether the last segment of the job has been completed. If so, the job is completed. If not, block 350 sets the sorter destination for the first copies in the next job segment. As indicated by flow chart linker C, the programming is then returned to block 330 to produce the copies needed for the second job segment. This program cycling continues until all job segments are completed.

Figure 8D:
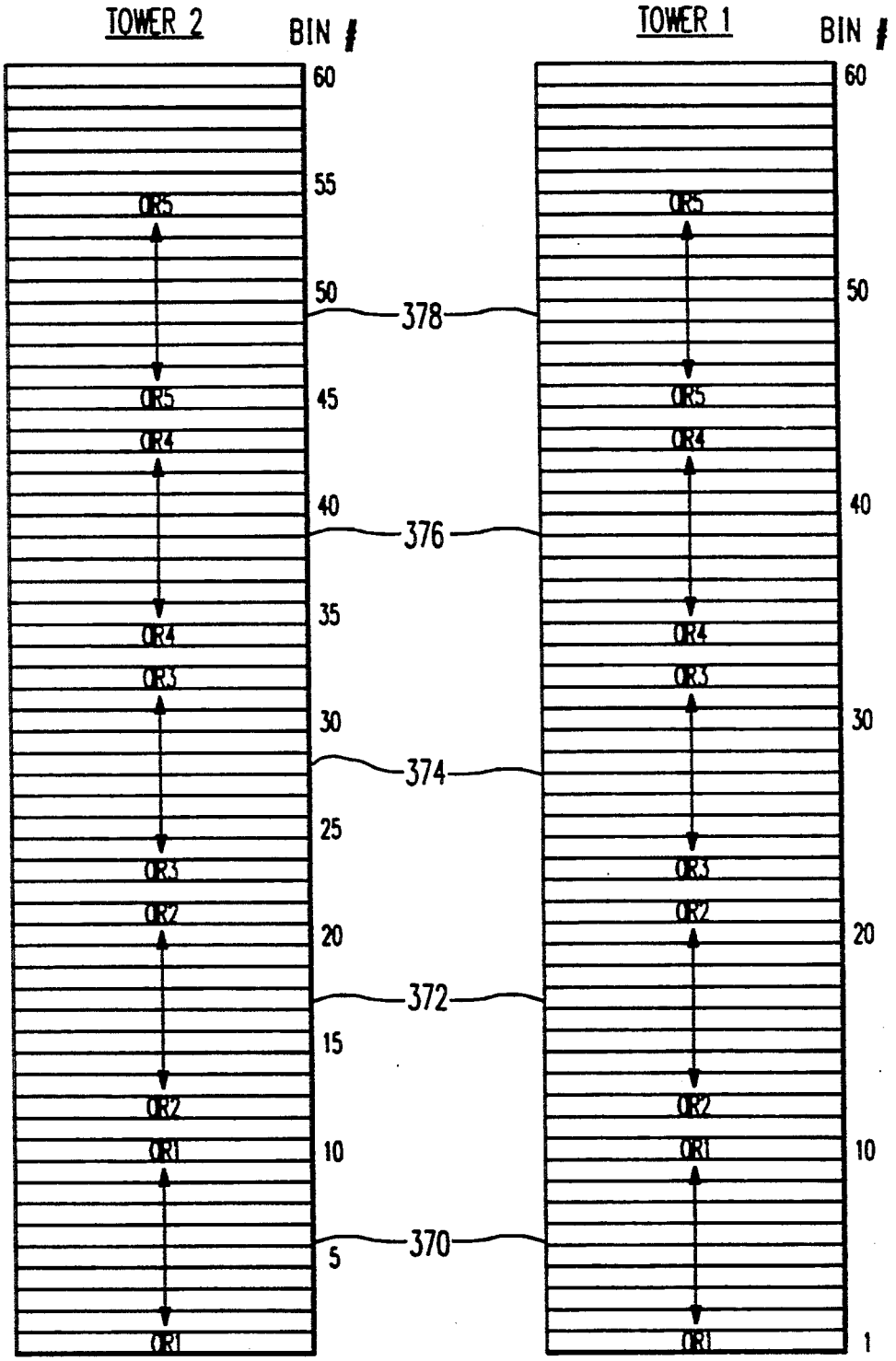
FIG. 8D illustrates the copy sorting results achieved by the copy system when it processes an exemplary copy job in accordance with the present invention.

Copy distribution in the sorter 14 is directed by the sorter control 20 (FIG. 6A) in accordance with commands and data received from the duplicator control 160 (FIG. 5A-1). As shown in FIG. 8D, commands and job attributes are received by functional block 352 by the sorter control 20 from the duplicator control 160 during programmed operation of the latter.

The sorter control 20 employs received data to schedule towers to receive produced copies in accordance with bin assignments and tower jogging requirements as indicated by block 354. Functional block 356 sends tower operating commands and bin assignments to the tower controls 86C, 100C, etc. (FIGS. 1 and 7A) in accordance with the tower schedule developed by the sorter control 20.

In turn, the each tower control operates the associated tower as previously described in connection with FIG. 7A. After the tower is sequenced into operation, the bin sequencing logic 214 executes the bin delivery assignment schedule as output copies are received. As previously indicated, the jogging control 241 goes into operation for one tower when delivery of copies is switched to the paired tower.

In summary, copies made of the same original in successive job segments are delivered to consecutive bins in the same bin area in the sorter 14 thereby providing efficient copy distribution that facilitates operator handling without confusion. Each common bin area can include bins from two different towers to enable tower jogging for stack alignment, but there is no confusing interspersing of copies of different originals like that in the prior art.

The sorting results for an illustrative copy job, performed in accordance with the present invention, is shown in FIG. 8D. In this case, the copy job specifies 1000 copies of each of 8 originals with assigned bins having a capacity of 100 copies. Because of the duplex tray limit, the total job is partitioned into 10 job segments. Respective common bin areas 370 through 384 are provided for respective copy stacks for the eight respective originals.

Each common bin area receives 10 job segments, each of which includes 100 copies. Further, each common bin area has consecutive bins that are divided between paired towers because of the tower jogging function provided in the preferred embodiment of the invention. Otherwise, the common bin area could comprise consecutive bins in a single tower.

As shown in FIG. 8D, all of the copies of the original OR1 are located in bins 1–10 of the two towers. All copies of the original OR2 are located in bins 12–21 of the two towers. Copies of the remaining originals OR3-OR8 are similarly located in the consecutive bin areas 374 through 384. The skipped bins 11, 22, etc. are explained in the aforementioned copending application (4629-034).

The foregoing description of a preferred embodiment of the invention has been presented to illustrate the invention. It is not intended to be exhaustive or to limit the invention to the precise form disclosed, and modifications and variations are possible in light of the disclosure herein or may be developed from practice of the invention. The embodiment was chosen and described to explain the principles of the invention and its practical application and to enable one skilled in the art to use the invention in various embodiments and with various modifications as are suited to the particular use contemplated. It is intended that the scope of the invention be defined by the claims appended hereto, and their equivalents.

What is claimed is:

1. A copy system comprising:

means for duplicating successive original documents;

said duplicating means having a limited capacity duplex tray for supporting copy processing in the duplex mode;

means for sorting output copies delivered from said duplicating means;

said sorting means including a plurality of towers each of which has a plurality of bins;

for transporting output copies to each of said towers;

means for directing output copies in each tower to each bin therein; and means for controlling said duplicating means and said transporting and directing means for said towers and said bins in the uncollated duplex mode to produce duplex copies in segment sizes up to the duplex tray capacity limit and to deliver copies of each original in successive copy segments to successive bins in a common bin area in one or more of said towers so as to form a copy stack for that original in said common bin area.

2. The copy system of claim 1 wherein said controlling means operates said transport and directing means to deliver copies to consecutive bins in said common bin area.

3. The copy system of claim 1 wherein said controlling means operates said transport and directing means to deliver successive copy stacks to consecutive common bin areas in said towers.

4. The copy system of claim 1 wherein said controlling means includes:

means for operating said duplicating means to count the number of original documents to be processed;

means for computing the sorter bin and tower capacity needed to satisfy a requested copy quantity and a programmed number of copies per bin; and means for indicating the maximum number of originals and for stopping said duplicating means if the sorter capacity is computed to be insufficient.

5. The copy system of claim 1 wherein said controlling means includes means for setting the segment size to the lower of the entered copy quantity and the duplex tray capacity.

6. The copy system of claim 4 wherein said controlling means includes means for setting the segment size to the lower of the entered copy quantity and the duplex tray capacity.

7. The copy system of claim 1 wherein each common bin area comprises bins in each of two paired towers and said controlling means further includes means for operating jogging bars in each tower after copies have been delivered to common area bins in that tower and while copies are being delivered to its paired tower.

8. The copy system of claim 4 wherein each common bin area comprises bins in each of two paired towers and said controlling means further includes means for operating jogging bars in each tower after copies have been delivered to common area bins in that tower and while copies are being delivered to its paired tower.

9. The copy system of claim 1 wherein said controlling means includes means for assigning towers and bins for successive copies in each job segment and for operating said transporting means and said directing means to deliver successive output copies in accordance with the tower and bin assignments.

10. The copy system of claim 4 wherein said controlling means includes means for assigning towers and bins for successive copies in each job segment and for operating said transporting means and said directing means to deliver successive output copies in accordance with the tower and bin assignments.

11. The copy system of claim 4 wherein up to ten or more towers are provided and wherein up to sixty or more bins are provided in each of said towers.

12. A method for operating a copy system, the steps of said method comprising:

operating a duplicator having limited duplex copying capacity to copy successive original documents in the duplex mode;

operating a sorter having a plurality of multiple-bin towers to sort output copies from the duplicator into the tower bins; and controlling the duplicator and towers and bins in the uncollated duplex mode to produce duplex copies in segment sizes up to the duplex copying capacity limit and to deliver copies of each original in successive copy segments to consecutive bins in a common bin area in one or more of the towers so as to form a copy stack for that original in the common bin area.

13. The method of claim 9 wherein the towers and bins in said controlling step are further operated to deliver copies to consecutive bins in the common bin area and to deliver successive copy segments to consecutive common bin areas in the towers.

* * * * *